US006512189B1

(12) United States Patent
Schuberth et al.

(10) Patent No.: US 6,512,189 B1
(45) Date of Patent: Jan. 28, 2003

(54) ROTARY SWITCH

(75) Inventors: Stefan Schuberth; Oliver Zegula, both of Bad Neustadt (DE)

(73) Assignee: Preh-Werke GmbH & Co. KG, Bad Neustadt/Saale (DE)

( * ) Notice: Subject to any disclaimer, the term of this patent is extended or adjusted under 35 U.S.C. 154(b) by 0 days.

(21) Appl. No.: 09/715,173

(22) Filed: Nov. 20, 2000

(30) Foreign Application Priority Data

Nov. 22, 1999 (DE) ..... 199 64 133

(51) Int. Cl.[7] ..... H01H 19/02
(52) U.S. Cl. ..... 200/334; 200/336; 200/61.08
(58) Field of Search ..... 200/61.08, 300, 200/334, 570, 571, 564, 336

(56) References Cited

U.S. PATENT DOCUMENTS 3,066,550 A * 12/1962 Sundberg ..... 200/336

FOREIGN PATENT DOCUMENTS

| | | | |
|---|---|---|---|
| DE | 2941626 | C2 | 4/1981 |
| DE | 19636643 | C1 | 2/1998 |
| DE | 19712294 | C2 | 8/1999 |
| DE | 19834374 | A1 | 2/2000 |

* cited by examiner

*Primary Examiner*—Renee Luebke
(74) *Attorney, Agent, or Firm*—Birch, Stewart, Kolasch & Birch, LLP

(57) ABSTRACT

A rotary switch or controller is structured to have a so-called impact criteria or characteristic by having members with predetermined yield, or breaking, points (5, 6) which are integrated into the rotary switch (1) so that when a high force acts on the rotary switch (1), a top part (2) of a rotary switch or rotary controller (1) is allowed to be collapsed into a front panel (4) of a passenger vehicle or commercial vehicle on which the rotary switch is used. These yield elements (5, 6) may be structured as ribs (6) that have intended breaking points (6.1) therebetween, or may be structured as spring elements (5).

15 Claims, 2 Drawing Sheets

ROTARY SWITCH

BACKGROUND OF THE INVENTION

This application claims a priority based on German application 199 64 133.1, filed Nov. 22, 1999, and the contents of that application are incorporated herein by reference.

The present invention relates to a rotary switch having a rotary knob, or button, with a rotary-knob lower part.

Rotary switches are often used in dashboard panels and other places in automotive engineering. Such rotary switches or rotary resistors are known from German Patent 197 12 294 C1, German Patent 196 36 643 C1 as well as German Patent Application 198 34 374 A1. In a particular structure, rotary switches are also structured as compact rotary controllers.

It is a disadvantage that known rotary switches, or rotary controllers, do not meet head-impact criteria, in that they often project too far out of the front panel of the dashboard of the vehicle in the event of a crash.

An object of this invention is to provide a rotary switch that conforms to head-impact criteria, or requirements.

SUMMARY OF THE INVENTION

According to principles of this invention, a rotary switch has predetermined yield, or breaking, points, or areas, which are provided on a rotary knob or a rotary-knob lower part so that when a high force acts on the rotary switch these members are collapsed at these yield points and the rotary knob is shifted toward a rotary-knob lower part.

This invention is based on the idea of integrating a displaceable, or collapsible, material into a rotary switch, for example by having yield points which permit the rotary switch to sink into a front panel of a passenger vehicle or commercial vehicle under increased pressure of an impact. Fracture, or breaking, point members may be structured as ribs that yield and have the predetermined yield points or they may be structured as spring elements. For deformation of the rotary switch into itself, hollow spaces are created into which the rotary knob, or a rotary-knob lower part, can be depressed, for which purpose these hollow spaces are built into the respective mating piece. These spaces are structured so that the ribs and spring elements have the opportunity to sink further in the event of a impact.

BRIEF DESCRIPTION OF THE DRAWINGS

Further benefits, characteristics and details of the invention are explained in more detail below using an embodiment shown in the drawings. The described and drawn features, can be used individually or in preferred combinations in other embodiments of the invention. The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE INVENTION

Figure 1:
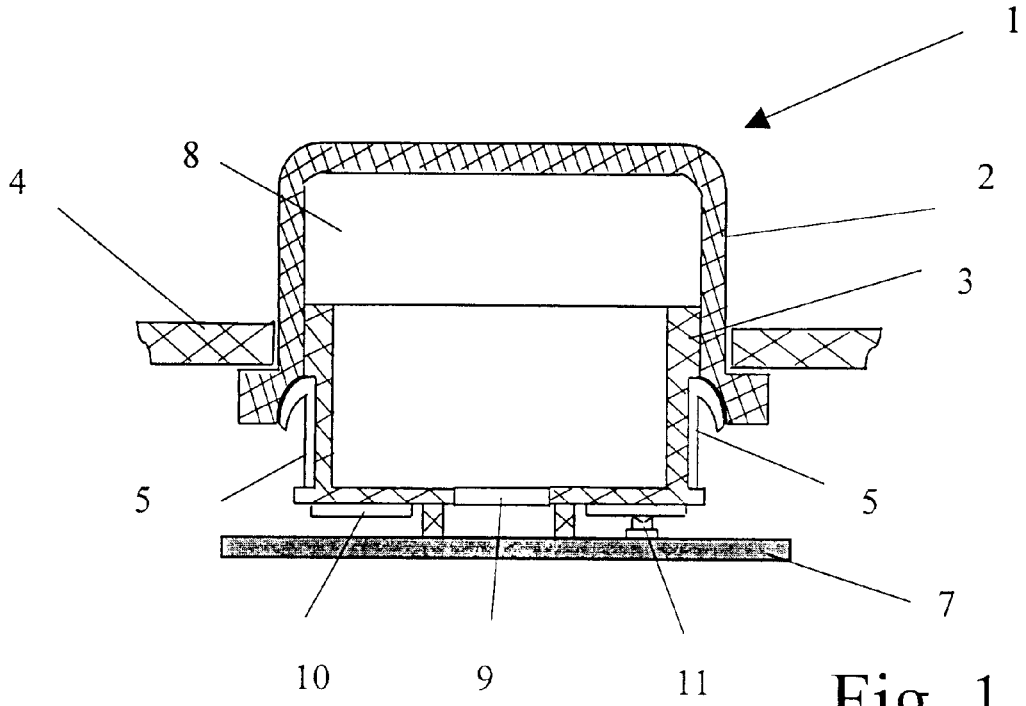
FIG. 1 is a vertical sectional view of a rotary switch of this invention in a particular structure as a rotary controller and having spring elements.

FIG. 1 shows a simplified representation of a rotary switch 1, represented here as a rotary controller, including a hollow rotary knob 2 that cooperates with a rotary-knob lower part 3 and is mounted in a panel 4, such as a front panel of a dashboard of a motor vehicle.

For meeting button impact criteria, or requirements, the rotary-knob lower part 3 (or rotary knob 2, which is not shown in detail here) has spring elements 5 distributed on its outer perimeter, extending into recesses in the rotary-knob lower part 3 or rotary knob 2. Between the rotary knob 2 and the rotary-knob lower part 3 there is a clearance, or space, 8. In addition, the rotary controller 1 has a bore 9, for example in the rotary-knob lower part 3, for a light coupling (not shown in detail here). A wiper plate 10 is mounted on the rotary-knob lower part 3 from which a signal is picked up in a known manner by a contact, or wiper, 11 of a base plate 7.

Figure 2:
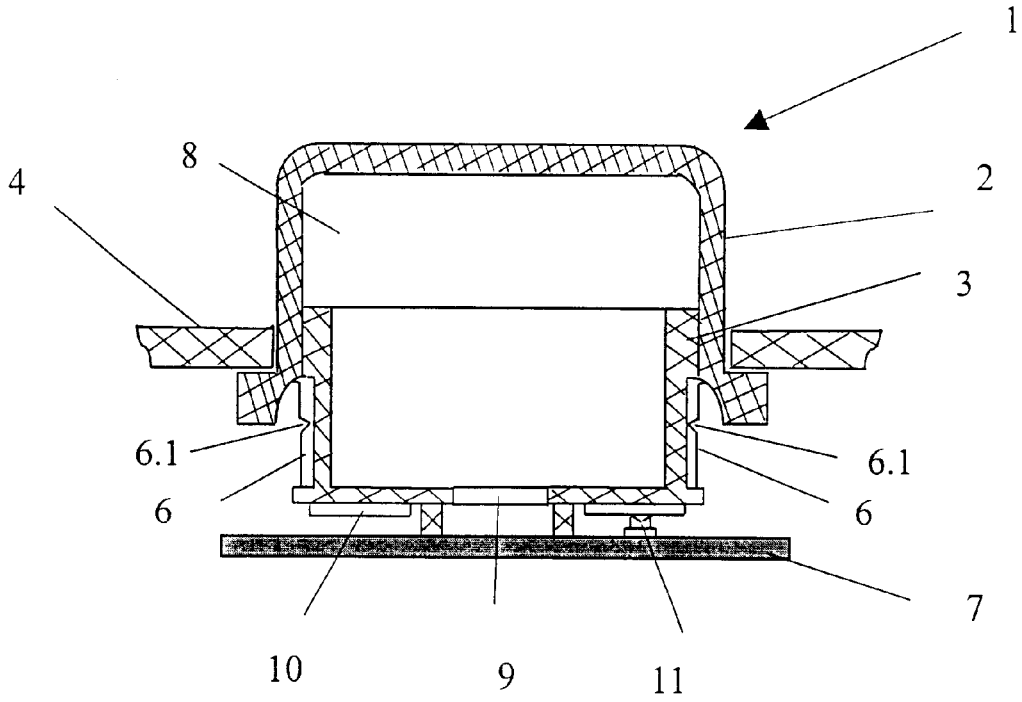
FIG. 2 is a view similar to FIG. 1 of a rotary switch of this invention having ribs.

FIG. 2 shows basically the rotary controller 1 from FIG. 1, but with frangible ribs 6. These ribs 6 have intended breaking point(s) 6.1 in predetermined areas. For the sake of simplicity, the same reference numbers are used in FIG. 2 as in FIG. 1, so that it is not necessary to repeat the reference numbers again in further describing FIG. 2.

A function of the spring elements 5 and the ribs 6 is described below.

In a case of an impact of a vehicle (not shown here) a higher force acts on the rotary controller 1 from the rear toward a direction of travel, for example due to an impact of a driver's body, this force being greater than a force of the spring elements 5 or the stability of ribs 6. This results in a yielding or collapsing of them, either at upper parts of the spring elements 5 or at the predetermined breaking points 6.1 of the ribs 6. The rotary knob 2 is no longer supported due to the yielding, or breaking, away of the spring elements 5 or the ribs 6 at the so-called yield or breaking points, and it moves through the panel 4 in the direction of the rotary-knob lower part 3 and the base plate 7 due to the acting force. The collapsed, or crushed, parts and rotary-knob lower part 3 are then pressed into the clearance, or space, 8 in the rotary knob 2.

If the spring elements 5 or the ribs 6 were on the rotary knob 2, the same movement would take place, and the rotary knob 2 would still move in the direction of the rotary-knob lower part 3, but in this case the clearance space would have to be present in the mating piece, that is, in the rotary-knob lower part 3.

Figure 3:
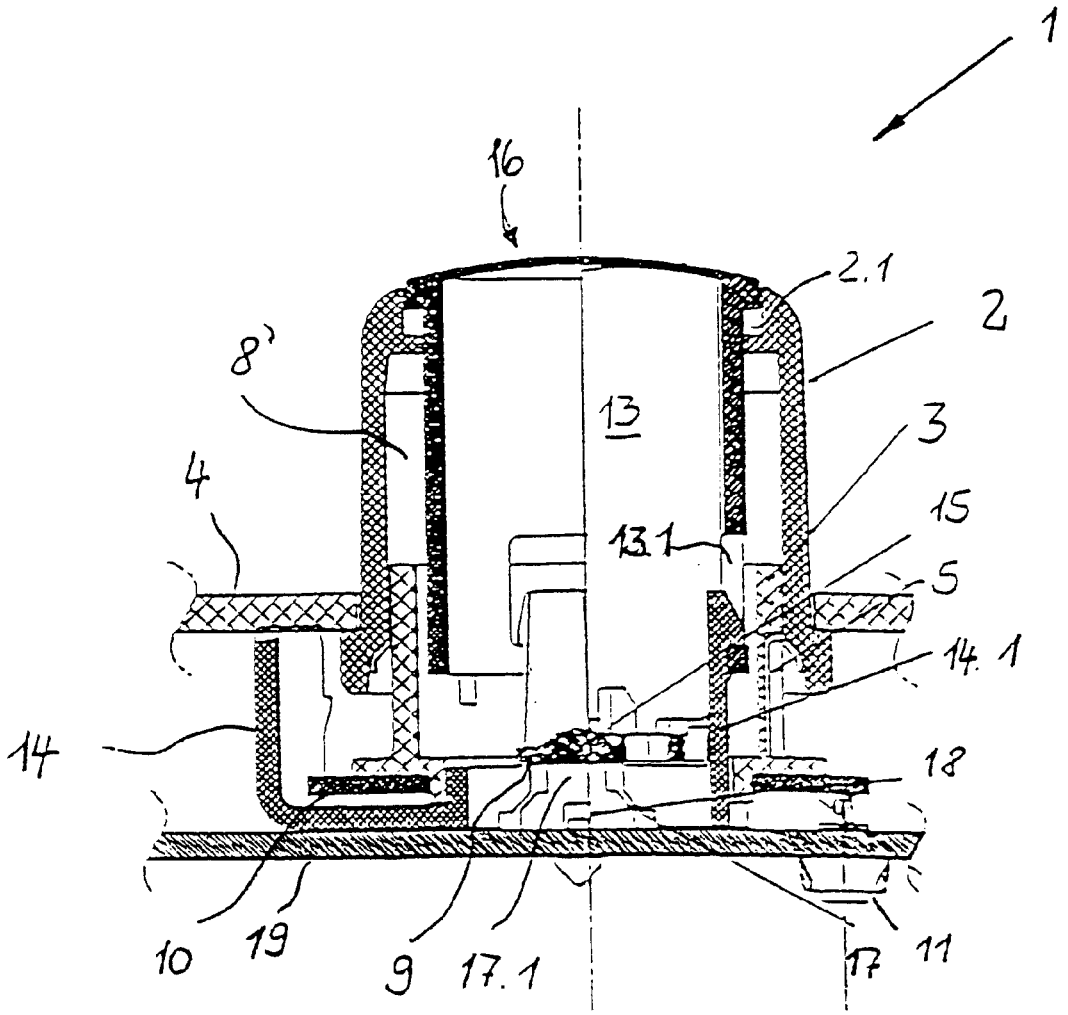
FIG. 3 is a vertical sectional view of a rotary controller of this invention in an embodiment having a key function.

In another embodiment of FIG. 3, a key 13 is integrated into a rotary knob 2 of the type in FIG. 1, the key being held mechanically by a holder 14. The rotary-knob lower part 3 is then supported on the holder 14. The key 13 has vertical guide grooves 13.1 in which the holder 14 engages with its retaining fingers 14.1. For uniform keying, preferably three guide grooves 13.1 are provided. The key path here is limited by a depression 2.1 in the rotary knob top part 2. If the key 13 is a hollow key element as in this embodiment, the retaining fingers 14.1 preferably engage with the guide grooves 13.1 from the inside.

The key 13 has a light guide 15, one end of which preferably extends into the key 13 and projects into a head area of the key 13 to illuminate a key symbol 16. This light guide 15 engages with a contact dome 17 that has a central passage 17.1 for a light of a light element 18 of a circuit board 19, for example an LED. Closing the contacts in the contact dome 17 with contacts on the circuit board 19 takes place via the contact dome 17 when the key 13 is depressed.

On impact of a vehicle, which is not shown in detail here, the rotary-knob lower part 3 is pushed into the clearance space 8' between the key 13 and the rotary knob 2 upon breakage, or yielding, of the upper part of the spring element 5 or the intended breaking points 6.1 of the ribs 6 of the rotary controller 1. The retaining fingers 14.1 leave the guide groove 13.1 in this process and bend into the hollow part of the key 13.

If the retaining fingers 14.1 were acting on the key 13 from the outside, they would also be displaced into the clearance 8'n, but a larger clearance 8' would have to be provided between the key 13 and the rotary knob 2, so that, in addition to the rotary-knob lower part 3, the retaining fingers 14.1 would also have room in this clearance space 8'.

However, this invention is not limited just to motor vehicles and commercial vehicles. The rotary controller 1 disclosed here may also be used in aircraft and in rail vehicles that must meet similar requirements, that is, the requirement that the rotary knob top part 2 should not continue to project out of the panel 4 when high forces are acting on it from the outside, so that the risk of injury can be reduced.

We claim:

1. A rotary switch having a rotary knob and a rotary-knob lower part formed as a separate piece from said rotary knob but cooperating therewith to transmit switch adjustments, wherein the rotary switch has members with predetermined yield points located on an outer perimeter of one of the rotary knob and the rotary-knob lower part for supporting the rotary knob, so that when a high force acts on the rotary switch, the members with predetermined yield points yield at these yield points and the rotary knob is collapsed toward the rotary-knob lower part, wherein the members with the predetermined yield points are formed as pieces separate from said rotary knob and the rotary-knob lower part; and wherein there is a key element that is additionally integrated into the rotary knob top part, and a holder that mechanically holds the key element, with the rotary-knob lower part being positioned on the holder, wherein said holder has retaining fingers engaging in guide grooves in the periphery of the key element.

2. The rotary switch of claim 1, wherein the members with predetermined yield points are crushed when they collapse.

3. The rotary switch of claim 1, wherein the one of the rotary knob and the rotary-knob lower part on whose outer perimeter the members with the predetermined yield points are located, are driven into a hollow cavity of the other of the rotary knob and the rotary-knob lower part, along with the members with the predetermined yield points when the rotary knob is collapsed toward the rotary-knob lower part.

4. The rotary switch of claim 1, wherein the members with predetermined yield points are formed by spring elements.

5. The rotary switch of claim 1, wherein the members with predetermined yield points are formed by ribs with intended breaking points.

6. The rotary switch of claim 1, wherein the members with predetermined yield points are driven into a hollow cavity between the rotary knob and the rotary-knob lower part while the retaining fingers leave the guide grooves.

7. The rotary switch of claim 6, wherein the key is placed over a light guide, which illuminates a facing area of the key to illuminate a key symbol thereon, and wherein the key engages a contact dome having a central opening.

8. A rotary switch as in claim 1, wherein the rotary-knob lower part has an electrical-contact wiper blade mounted thereon for further transmitting said switch adjustments.

9. A rotary switch having a rotary knob and a rotary-knob lower part formed as a separate piece from said rotary knob but cooperating therewith to transmit switch adjustments, wherein the rotary switch has members with predetermined yield points located on an outer perimeter of one of the rotary knob and the rotary-knob lower part for supporting the rotary knob, so that when a high force acts on the rotary switch, the members with predetermined yield points yield at these yield points and the rotary knob is collapsed toward the rotary-knob lower part, wherein the members with predetermined yield points are formed of pieces separate from said rotary knob and the rotary-knob lower part and they are located in recesses of the one of the rotary knob and the rotary-knob lower part before the rotary knob is collapsed toward the rotary-knob lower part.

10. The rotary switch of claim 1, wherein there is a key element that is additionally integrated into the rotary knob top part, and a holder that mechanically holds the key element, with the rotary-knob lower part being positioned on the holder, wherein said holder has retaining fingers engaging in guide grooves in the periphery of the key element.

11. The rotary switch of claim 10, wherein the members with predetermined yield points are driven into a hollow cavity between the rotary knob and the rotary-knob lower part while the retaining fingers leave the guide grooves.

12. The rotary switch of claim 11, wherein the key is placed over a light guide, which illuminates a facing area of the key to illuminate a key symbol thereon, and wherein the key engages a contact dome having a central opening.

13. A rotary switch having a rotary knob and a rotary-knob lower part formed as a separate piece from said rotary knob but cooperating therewith to transmit switch adjustments, wherein the rotary switch has members with predetermined yield points located on an outer perimeter of one of the rotary knob and the rotary-knob lower part for supporting the rotary knob, so that when a high force acts on the rotary switch, the members with predetermined yield points yield at these yield points and the rotary knob is collapsed toward the rotary-knob lower part, wherein there is a key element that is additionally integrated into the rotary knob top part, and a holder that mechanically holds the key element, with the rotary-knob lower part being positioned on the holder, wherein said holder has retaining fingers engaging in guide grooves in the periphery of the key element.

14. The rotary switch of claim 13, wherein the members with predetermined yield points are driven into a hollow cavity between the rotary knob and the rotary-knob lower part while the retaining fingers leave the guide grooves.

15. The rotary switch of claim 14, wherein the key is placed over a light guide, which illuminates a facing area of the key to illuminate a key symbol thereon, and wherein the key engages a contact dome central opening.

* * * * *